US005643105A

United States Patent [19]

Niswander

[11] Patent Number: 5,643,105

[45] Date of Patent: Jul. 1, 1997

[54] GOLF CLUB WITH MALE HOSEL AND REINFORCING SLEEVE

[75] Inventor: Dwight J. Niswander, Camarillo, Calif.

[73] Assignee: Wilson Sporting Goods Co., Chicago, Ill.

[21] Appl. No.: 605,952

[22] Filed: Feb. 23, 1996

[51] Int. Cl.[6] ..... A63B 53/02

[52] U.S. Cl. ..... 473/308; 473/309

[58] Field of Search ..... 473/305, 306, 473/307, 308, 309, 310, 311, 312, 313, 315

[56] References Cited

U.S. PATENT DOCUMENTS

| | | |
|---|---|---|
| 796,802 | 8/1905 | Brown . |
| 1,882,509 | 10/1932 | Lagerblade . |
| 1,894,707 | 1/1933 | Reach . |
| 2,363,991 | 11/1944 | Reach . |
| 3,170,691 | 2/1965 | Pritchard . |
| 3,397,888 | 8/1968 | Springer . |
| 3,410,558 | 11/1968 | Reuter, Jr. . |
| 3,825,991 | 7/1974 | Cornell . |
| 3,843,122 | 10/1974 | Florian . |
| 4,063,737 | 12/1977 | Tom . |
| 4,892,316 | 1/1990 | Langert . |
| 4,895,368 | 1/1990 | Geiger . |
| 5,181,720 | 1/1993 | Stites . |
| 5,184,819 | 2/1993 | Dedsbiolles . |
| 5,205,552 | 4/1993 | Green, Jr. . |
| 5,275,408 | 1/1994 | Desbiolles . |
| 5,395,109 | 3/1995 | Fenton, Jr. . |
| 5,439,218 | 8/1995 | Gondeck . |

FOREIGN PATENT DOCUMENTS

| | | |
|---|---|---|
| 59-196253 | 6/1983 | Japan . |
| 64-967 | 6/1987 | Japan . |
| 1-130760 | 3/1988 | Japan . |
| 3-75764 | 11/1989 | Japan . |
| 4-15963 | 5/1990 | Japan . |
| 3-168165 | 11/1990 | Japan . |
| 5-53672 | 12/1991 | Japan . |
| 6-31015 | 5/1993 | Japan . |
| 332354 | 7/1930 | United Kingdom . |

*Primary Examiner*—Sebastiano Passaniti

[57] ABSTRACT

A golf club includes a male hosel which is inserted into the lower end of a shaft. A sleeve is positioned over the lower end of the shaft and over a radially enlarged portion of the hosel. The shaft abuts a first radially extending shoulder on the hosel, and the sleeve abuts a second radially extending shoulder on the hosel.

12 Claims, 1 Drawing Sheet

12
29
27
32
30
11
17
15
19
14
18
10
13
16
28
31
21
22
24
25
23

GOLF CLUB WITH MALE HOSEL AND REINFORCING SLEEVE

BACKGROUND AND SUMMARY

This invention relates to golf clubs, and, more particularly, to a golf club with a male hosel and an outer reinforcing sleeve.

A golf club conventionally comprises a clubhead and a shaft. The shaft is attached to the clubhead by a hosel which extends upwardly from the clubhead. Most clubheads have female tubular hosels, and the shaft is inserted into the bore of the female hosel. Some golf clubs have male hosels, and the hosel is inserted into the shaft.

Some golf clubs with male hosels are subject to various problems. For example, the bottom or tip of the shaft is often exposed, and the shaft can split at the tip. Also, the shaft is subject to bending at the upper end of the male hosel.

The invention provides a male hosel golf club with an outer reinforcing sleeve which extends over the bottom portion of the shaft and over a stepped portion of the hosel. The upper end of the sleeve extends above the upper end of the male hosel and reinforces the shaft above the hosel. The lower end of the sleeve extends below the tip of the shaft and reinforces the tip of the shaft. The lower end of the sleeve is secured to the stepped portion of the hosel to provide additional strength to the hosel area. The inside of the shaft is adhesively secured to the male hosel, and the outside of the shaft is adhesively secured to the sleeve. If desired, the sleeve may be formed from a different material than the hosel, for example, lightweight yet strong titanium.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3, 4:
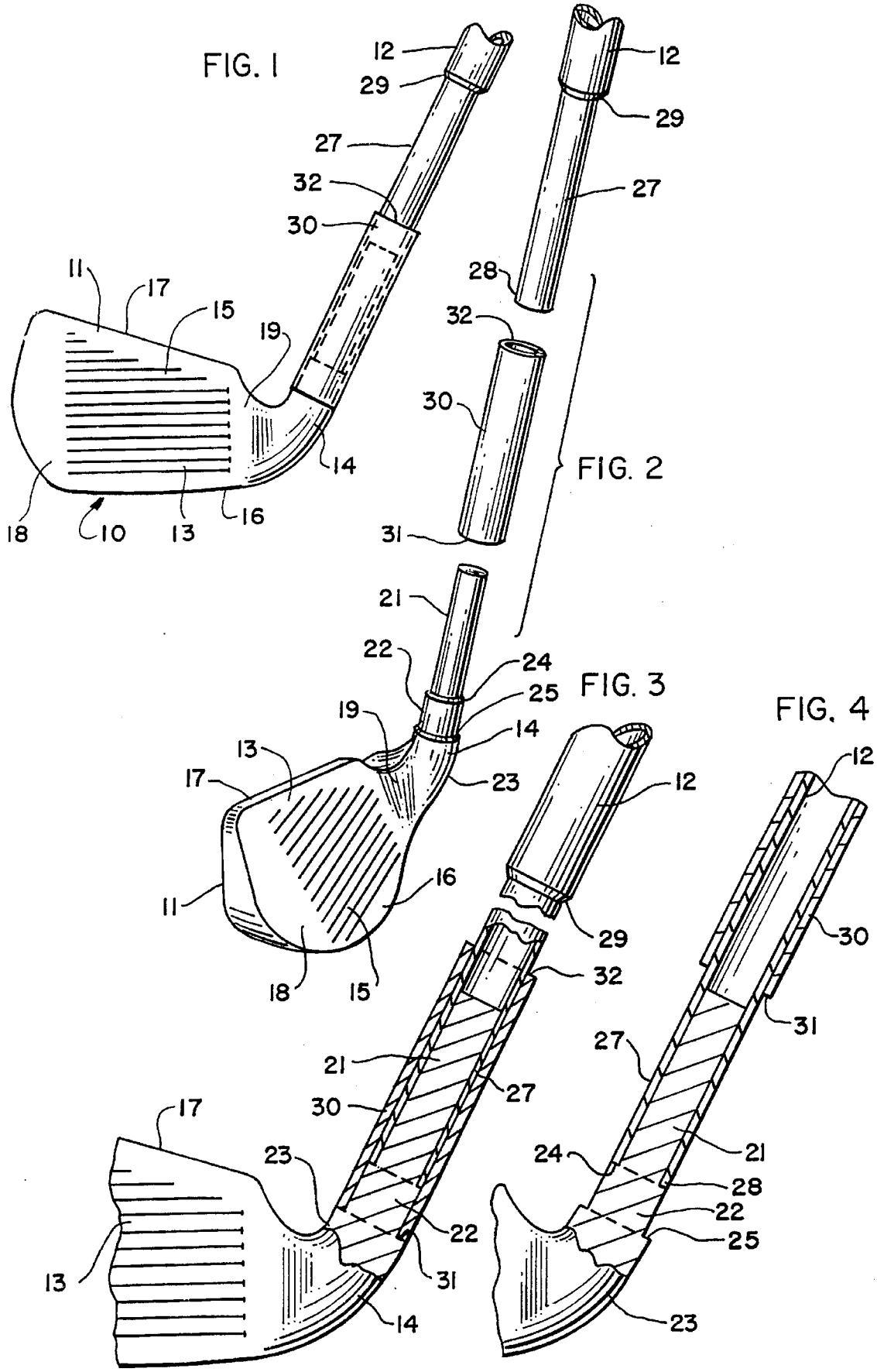
FIG. 1 is a fragmentary front elevational view of a golf club formed in accordance with the invention.
FIG. 2 is a fragmentary exploded perspective view of the golf club.
FIG. 3 is a fragmentary front elevational view, partially broken away, of the golf club.
FIG. 4 is a view similar to FIG. 3 illustrating the assembly procedure.

A golf club 10 includes a clubhead 11 and a shaft 12. A conventional grip (not shown) is secured to the upper end of the shaft. The particular clubhead illustrated is an iron-type of clubhead, but it will be understand that the invention can also be used with wood-type clubheads which are made of wood, metal, or other conventional material.

The clubhead 11 includes a body 13 and a hosel 14 which extends upwardly from the body. The body includes a striking face 15, a sole 16, a topline 17, and toe and heel portions 18 and 19. The clubhead can be integrally formed by casting or forging.

The hosel 14 includes a cylindrical upper end portion 21, a second cylindrical or stepped portion 22, and an attaching portion 23 which extends from the heel. The two cylindrical portions are concentric, and the diameter of the second cylindrical portion 22 is greater than the diameter of the end portion 21. The two cylindrical portions are joined by a radially extending annular shoulder 24. A lower radially extending annular shoulder 25 joins the second cylindrical portion 22 and the attaching portion 23.

The particular shaft 12 illustrated is a conventional metal shaft which includes a cylindrical lower end portion 27 which terminates in a bottom end or tip 28. The diameter of the shaft is progressively increased toward the upper end by a plurality of radially enlarged steps 29. The shaft can also be formed from composite material such as graphite fibers and resin. Composite shafts conventionally have a smooth taper.

The inside diameter of the lower end portion 27 of the shaft is just slightly larger than the outside diameter of the end portion 21 of the hosel, and the shaft fits snugly over the end portion 21. The tip 28 of the shaft abuts the shoulder 24 at the bottom of the end portion 21. The outside diameter of the second cylindrical portion 22 of the hosel is substantially the same as the outside diameter of the bottom of the shaft so that the outer surfaces of the second cylindrical portion and the shaft are substantially flush.

A cylindrical sleeve 30 extends over the lower end portion of the shaft and the second cylindrical portion. The bottom end 31 of the sleeve abuts the lower annular shoulder 25 of the hosel. The upper end 32 of the sleeve preferably extends beyond the upper end of the end portion 21 of the hosel to reinforce the shaft against bending at the upper end of the hosel. The sleeve encloses the tip of the shaft and extends downwardly beyond the tip to the shoulder 25 to protect and reinforce the bottom of the shaft.

The shaft is secured to the upper end portion 21 of the hosel by epoxy or other suitable adhesive. The sleeve 30 is secured to both the shaft and the second cylindrical portion 22 by epoxy or other adhesive. Attaching the sleeve to both the shaft and the second cylindrical portion 22 reinforces the attachment of the shaft to the clubhead.

The body and the hosel may be formed from stainless steel or other conventional clubhead material. The sleeve 30 is advantageously formed from titanium. Titanium is extremely strong but is lightweight. A titanium sleeve can therefore provide significant reinforcement to the hosel area without a significant increase in weight. Alternatively, the sleeve can be formed from aluminum, stainless steel, composite material, etc.

FIG. 4 illustrates a convenient method of attaching the shaft and the sleeve. The sleeve is pushed upwardly over the shaft to the first step 29. If the shaft is made from composite material, the sleeve is pushed upwardly until the taper of the shaft prevents further movement or until the bottom of the sleeve is spaced from the tip of the shaft approximately the length of the sleeve. Epoxy or other adhesive is spread over the end portion 21 of the hosel, and the shaft is pushed downwardly over the end portion. Epoxy or other adhesive is then spread over the outside surfaces of the shaft and the second cylindrical portion 22, and the sleeve is pushed downwardly until it abuts the shoulder 25.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A golf club comprising a clubhead and a shaft, the clubhead having a body with a striking face and a hosel extending from the body, the hosel having a cylindrical end portion and a second cylindrical portion between the cylindrical end portion and the body and a radially extending shoulder between the cylindrical end portion and the second cylindrical portion, the cylindrical end portion and the second cylindrical portion being concentric and the diameter of the second cylindrical portion being greater than the diameter of the cylindrical end portion, the cylindrical end portion of the hosel being inserted into and secured to a lower end portion of the shaft, so that the shaft abuts said radially extending shoulder, and a sleeve extending over the lower end portion of the shaft and over the second cylindrical portion of the hosel.

2. The golf club of claim 1 in which the sleeve is secured to the lower end of the shaft and to the second cylindrical portion of the hosel.

3. The golf club of claim 1 in which the hosel includes a second radially extending shoulder between the second cylindrical portion and the body and the sleeve abuts the second shoulder.

4. The golf club of claim 1 in which the diameter of the second cylindrical portion of the hosel is substantially the same as the outside diameter of the lower end portion of the shaft and the sleeve fits relatively snugly over the lower end portion of the shaft and the second cylindrical portion.

5. The golf club of claim 1 in which the sleeve extends axially beyond the cylindrical end portion.

6. The golf club of claim 1 in which the hosel and the sleeve are formed from different metals.

7. The golf club of claim 6 in which the sleeve is formed from titanium.

8. A golf club comprising a clubhead and a shaft, the clubhead having a body with a striking face and a hosel extending from the body, the hosel having a cylindrical upper end portion and a second cylindrical portion between the cylindrical end portion and the body, the second cylindrical portion having upper and lower ends and a diameter which is greater than the diameter of the cylindrical end portion, a first radially extending shoulder which joins the cylindrical end portion and the upper end of the second cylindrical portion, a second radially extending shoulder which extends outwardly from the lower end of the second cylindrical portion, the shaft having a lower end portion which is inserted over the cylindrical upper end portion of the hosel and abuts the first shoulder, and a sleeve which extends over the lower end portion of the shaft and the second cylindrical portion of the hosel and abuts the second shoulder.

9. The golf club of claim 8 in which the diameter of the second cylindrical portion of the hosel is substantially the same as the outside diameter of the lower end portion of the shaft and the sleeve fits relatively snugly over the lower end portion of the shaft and the second cylindrical portion.

10. The golf club of claim 9 in which the sleeve extends axially beyond the cylindrical end portion.

11. The golf club of claim 10 in which the hosel and the sleeve are formed from different metals.

12. The golf club of claim 11 in which the sleeve is formed from titanium.

* * * * *